United States Patent [19]

Rudy

[11] 4,219,945

[45] Sep. 2, 1980

[54] FOOTWEAR

[75] Inventor: Marion F. Rudy, Northridge, Calif.

[73] Assignee: Robert C. Bogert, Woodland Hills, Calif. ; a part interest

[21] Appl. No.: 918,790

[22] Filed: Jun. 26, 1978

Related U.S. Application Data

[63] Continuation-in-part of Ser. No. 830,589, Sep. 6, 1977, Pat. No. 4,183,156.

[51] Int. Cl.[2] ..... A43B 13/20; A43B 13/38

[52] U.S. Cl. ..... 36/29; 36/44

[58] Field of Search ..... 36/28, 29, 35 R, 35 B, 36/71, 88, 93, 96, 44; 264/299, 230, 234, 319; 128/90, 382, 383; 2/2.5, 413, 414, DIG. 3, DIG. 10

[56] References Cited

U.S. PATENT DOCUMENTS

| | | | |
|---|---|---|---|
| 1,304,915 | 5/1919 | Spinney | 36/29 |
| 2,100,492 | 11/1937 | Sindler | 36/29 |
| 2,189,813 | 2/1940 | McGuire | 36/29 |
| 2,739,093 | 3/1956 | Bull | 36/29 X |
| 3,410,004 | 11/1968 | Finn | 36/29 X |
| 3,589,037 | 6/1971 | Gallagher | 36/44 |
| 3,760,056 | 9/1973 | Rudy | 36/71 |

*Primary Examiner*—Patrick D. Lawson

*Attorney, Agent, or Firm*—Subkow and Kriegel

[57] ABSTRACT

A shoe embodying a multiple chambered pneumatically inflated insert encapsulated in a yieldable foam which acts as a bridging moderator filling in irregularities of the insert and providing a substantially smooth and contoured surface for supporting the foot in a comfortable manner. The encapsulated insert can be used as an inner sole slipped into an existing shoe, or it can be used as an integral, composite midsole or outsole portion of a shoe.

25 Claims, 11 Drawing Figures

FOOTWEAR

The present invention is a continuation-in-part of application Ser. No. 830,589, filed Sept. 6, 1977, now U.S. Pat. No. 4,183,156 for "Improved Insole Construction for Articles of Footwear".

The present invention relates to articles of footwear, and more particularly to pneumatically inflated inserts encapsulated in yieldable moderators adapted to form an integral part of footwear, or to be added to existing footwear.

Moderators and insole combinations are disclosed in the above copending application, Ser. No. 830,589, wherein pneumatically inflated, thin-walled yieldable inserts, such as insoles, have been proposed which embody a plurality of chambers containing the inflation medium, and which are used in conjunction with flexible moderators overlying the inserts. The moderator, although flexible, is somewhat rigid, bridging spaces or irregularities of the upper surface of the insert, and thereby transmitting the force of the foot in a comfortable manner through the inflated insert to the underlying shoe portions.

During running, walking or other uses of the combination, the inflated insole deflects, which may, under some circumstances, cause sharp bends and folds in the film material of the insert when under severe compression and shear forces, tending to lower the life expectancy of the insert. When used as an insole installed within the upper portion of the shoe, the yieldability of the insert permits the person's foot to partake of some vertical movement relative to the shoe upper and heel portion. If the shoe is not properly designed to accommodate this motion, chafing and blisters can occur. When shoes embodying the pneumatic insole are used in some athletic activities, such as running, the inflated insole, which functions as an air spring, tends to rebound very rapidly from its compressed condition. Under certain circumstances, the athlete prefers to slow and more precisely control this rebound characteristic.

In connection with the insole and moderator combination installed within the upper portion of the shoe as referred to above, the shoe design requires modification to allow additional space between the outer soles and counter to accommodate the insole, the last of the shoe also requiring redesign. The completed shoe, therefore, has different proportions than the conventional shoe. This introduces the costly requirement of re-designing the shoe last and then retooling the production facility with new lasts and manufacturing procedures to properly incorporate the inflated insert into the article of footwear. This can also result in increased weight to the shoe.

With the present invention, a pneumatic inflated insert is provided which is encased or encapsulated in an elastic member that acts as a moderator, filling in the external irregularities of the inflated insert and providing a smooth and/or contoured surface comfortably supporting the foot. Sharp bends and folds in the film material are prevented from developing, extending the service life of the inflated insert beyond the life expectancy of an inflated insert which is not encased or encapsulated. The encapsulating material is preferably an elastic foam which fills in the unsupported perimeter around the inflated insert, ensuring support by the encapsulating foam of all portions of the insert and providing a more stable supporting platform for the foot.

The foam encapsulating material enveloping and in intimate contact with the inflated insert acts as a dashpot, slowing down the rate of energy rebound, and causing it to be more in tune with body movements.

The encapsulating material is capable of deforming to transfer the load imposed upon it to the inflated insert. The hardness of the foam is preferably matched with and proportional to the pneumatic inflation pressure within the insert. Where the internal fluid pressure within the inflated insole is high, a stiffer foam encapsulating material is generally used. Conversely, for lower pneumatic inflation pressures, progressively softer foam encapsulation material is used.

The encapsulated, pneumatically-inflated insert can form an integral part of the shoe, as by constituting its midsole or outsole portion. The vertical and lateral movement necessary to protect the foot, legs and body from injury and provide comfort are thus confined nearly totally to the inflated inner member and midsole section of the shoe. This reduces motion that might occur between the foot and the shoe, and makes the inflated insert immediately adaptable to virtually any article of footwear simply by replacing the conventional midsole or outsole element of the shoe with the foam encapsulated inflated insert properly cemented into the shoe, exactly the same way as with the conventional midsole or outsole. The conventional shoe last and design remain unchanged.

The inflation medium for the insert may be air alone, but preferably includes a mixture of special gases, other than air, filling the insert chambers. The special gas or gases used have low solubility coefficients and have large molecules incapable of diffusing outwardly from the chambered insert, which is made of a permeable elastomeric material, except at a relatively low rate, The surrounding air, however, can pass through the permeable material into the chambers by reverse diffusion to progressively increase the total pressure in the insert chambers over a period of several months, as described in the above-identified application, Ser. No. 830,589. The material encasing or encapsulating the insole is also preferably permeable to allow passage of the ambient air through the encapsulating material and through the insole into its chambers.

The incorporation of the inflated insert within the encapsulating material or foam to provide a midsole results in a decrease in the weight of the shoe. Such weight can be further decreased by providing openings or passages in the encapsulating foam at pre-selected locations. The openings are insufficient in number and extent as to interfere with a smooth, properly contoured platform for supporting the foot and have the beneficial effect of adding to the ventilation within the shoe.

This invention possesses many other advantages, and has other objects which may be made more clearly apparent from a consideration of several forms in which it may be embodied. Such forms are shown in the drawings accompanying and forming part of the present specification. These forms will now be described in detail for the purpose of illustrating the general principles of the invention; but it is to be understood that such detailed description is not to be taken in a limiting sense.

Referring to the drawings.

Figure 1:
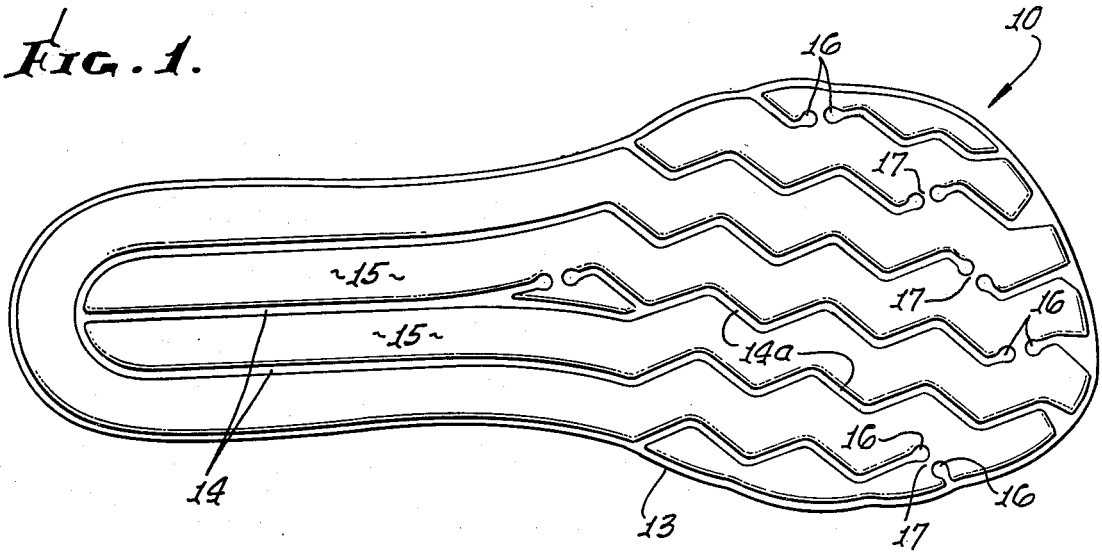
FIG. 1 is a top plan view of an inflated insert, which can function as an insole, or part of a composite midsole or outsole of a shoe.
Figure 3:
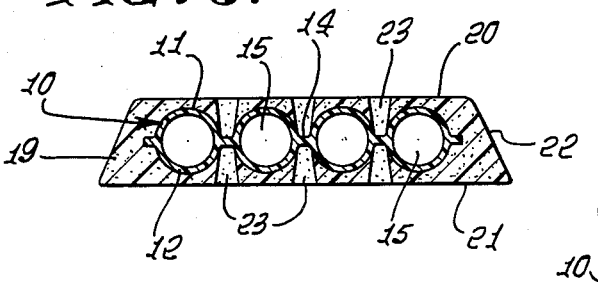
FIG. 3 is an enlarged cross-section taken along the line 3—3 on FIG. 2.

As shown in FIG. 1, an inflated insert 10 is adapted to be used in an article of footwear, the insert being capable of functioning as an insole, or embodied in a midsole or outsole, as described hereinbelow. If an outsole is omitted from the shoe, then the midsole containing the inflated insert will function as the outsole and be engagable with the ground or other supporting surface on which the shoe is used. The inflated insert comprises two layers 11, 12 (FIG. 3) of a thin-walled, highly stressed elastomeric material whose outer perimeter 13 generally conforms to the outline of the human foot. The two layers are sealed or welded to one another (e.g., welded, as by a radio frequency welding operation) around the outer periphery 13 thereof and are also welded to one another along weld lines 14 to form a multiplicity of generally longitudinally extending tubular sealed chambers or compartments 15.

The material from which the insert is constructed is relatively impermeable to diffusion of special gases contained therein with the material thus forming a fluid barrier to prevent escape of the special fluid or gas from the chambers.

The weld lines 14 which define the tubular chambers terminate at points 16 which are located under no-load bearing area of the wearer's foot. The spaces 17 between the termination points provide intercommunicating passages through which the pressurized fluid can flow freely between the chambers 15, so that the pressure in all chambers is the same at any instant of time.

As shown in FIG. 1, the forward portion of the insert has its weld lines **14*a* arranged in a generally herringbone pattern to provide tubular chambers of generally zig-zag shape. This specific insole construction is illustrated in the above-identified application Ser. No. 830,589 and has the advantage of lying substantially flat, thereby facilitating its use in a shoe. It is found that when pressurized, the rear portion of the insert 10** may curl to a slight extent, but the herringbone front portion resists its curling and reduces it to such an extent that it does not interfere with the assembly of the insert with other portions of the shoe.

The insert is inflated by injecting a special large molecule gas with low solubility coefficient into it. This is performed by puncturing one of the chambers with a hollow needle through which the inflating gas is introduced until the desired pressure in the chambers is reached, after which the needle is withdrawn and the puncture formed by it sealed. The inflation medium may be the large molecule gas alone, or a mixture of the gas and air, or air alone, although, as described hereinbelow, it is preferred to use the large molecule gas. When one or a combination of these special gases are used, it is found that the pressure in the chambers 15 increases at first to a level higher than the initial inflation pressure, and then gradually decreases. The pressure increase is due to diffusion-pumping (reverse diffusion) of air into the insert. The effective inflated life of the insert can be as high as 5 years when such diffusion-pumping of air occurs. When air is thus used to provide a portion of the inflation pressure of the insert, its inflated life is also extended by virtue of the fact that such air cannot normally diffuse out because the internal pressure of the air is in equilibrium with the pressure of the outside ambient air. Such internal air can be introduced into the system either by the mechanism of diffusion-pumping, which is preferable, or by initially inflating the insert with mixtures of air and the special large molecule gas (or gases).

Figure 2:
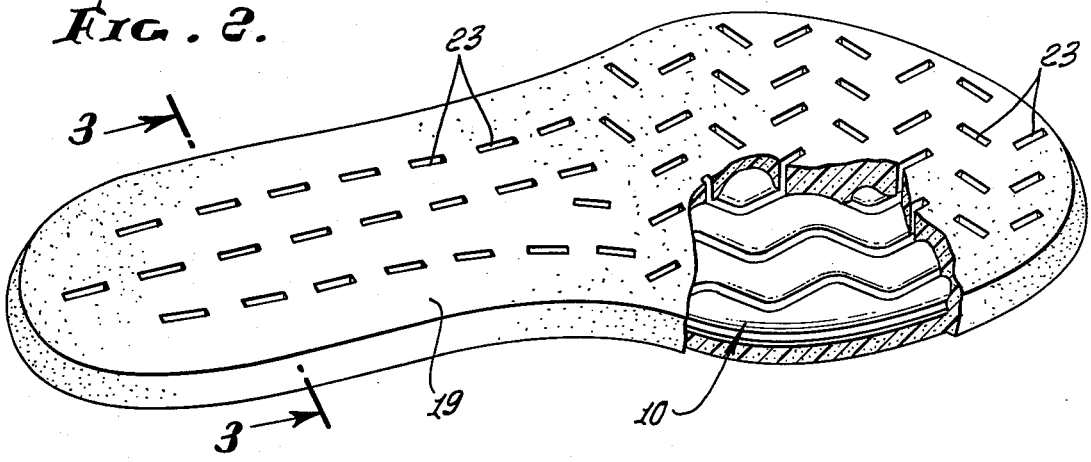
FIG. 2 is an isometric view, with a portion broken away, of the insert of FIG. 1 encapsulated in a foam to provide a composite insert and moderator structure adapted to be used as an insole, or as the midsole or outsole portions of the shoe.
Figure 6:
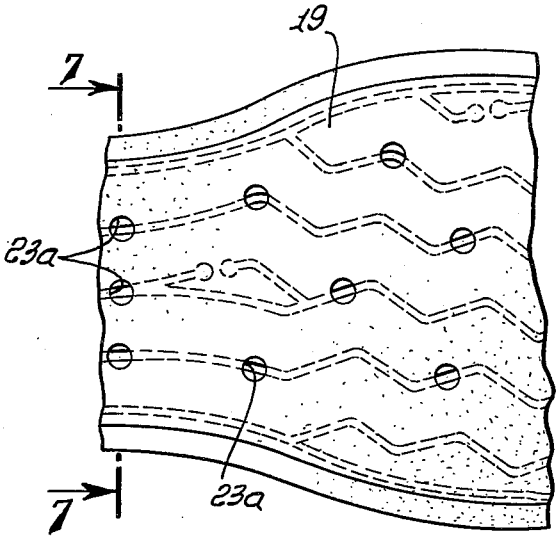
FIG. 6 is a top plan view of a portion of an encapsulated insert disclosing openings which are produced as a result of the foam encapsulating operation.
Figure 7:
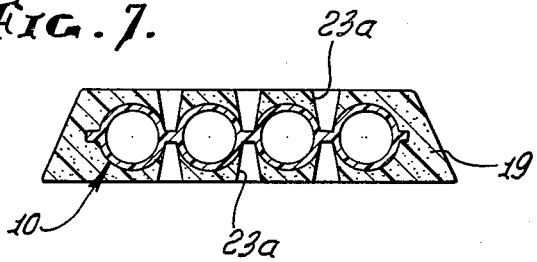
FIG. 7 is a cross-section taken along the line 7—7 on FIG. 6.

The inflated insole is encapsulated in a foam 19 within a suitable mold (not shown), the foam material being elastomeric and permeable. The inflated insole is appropriately positioned within a suitable mold, with the required space provided around the insert. The insole may be retained in the mold by pins, or the like (not shown), bearing against upper and lower sides of the weld areas 14. The uncured, liquid polymer, catalyst and foaming agent are injected into the mold cavity, the foamed elastomeric material expanding to fill the space between the insert and the mold walls. The foam material is allowed to cure and bond to the insole, resulting in the upper and lower substantially flat surfaces 20, 21 and side surfaces 22 of the encapsulating material, as well as spaces 23 extending outwardly from the weld lines 14 after the mold has been opened and the pins (not shown) withdrawn. The spaces or openings 23 that remain may be rectangular, as shown in FIG. 2, or circular as disclosed in FIG. 6 at **23*a***, or may possess any suitable shape.

Figure 9:
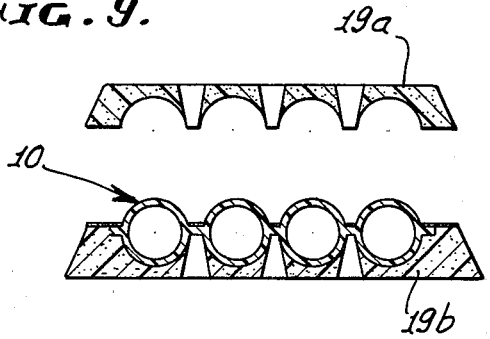
FIG. 9 is an exploded cross-sectional view of an insert and encapsulating foam in which the foam is made in two parts adapted to received the insert, after which the parts are suitably secured together.

Another manner of enclosing the insert 10 in elastomeric material is to preform the upper and lower portions **19*a*, 19*b* of the encapsulating member, to conform to the shape of the insert 10, such as shown in FIG. 9. The two parts of the encapsulating member are then moved toward each other around the insert 10**, the two parts being adhered to one another and to the insert itself by a suitable cement or other bonding process.

Producing the encapsulated insert by injecting the foamed elastomeric material into the mold containing the insert 10 has a disadvantage in that foaming and curing of the material is preferably carried out at temperatures below approximately 170° F., to avoid deterioration of the material from which the insert is made. Pre-forming the foam members **19*a*, 19*b* by injection molding them in suitable dies (not shown), so that the members match the inflated shape of the insole 10, followed by cementing the shaped foam members to the upper and bottom surfaces of the insole 10, to create a composite foam encapsulated insole 19, 10**, possesses the advantage that the foaming process can take place without any temperature limitations, since the injection molding step is performed in a suitably designed die out of contact with the inflated insole element.

Figure 4:
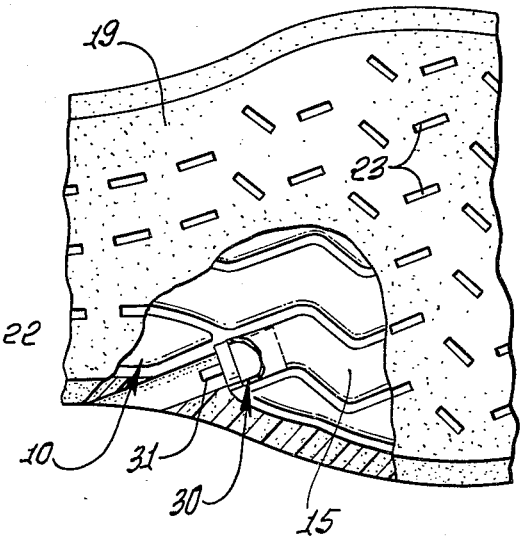
FIG. 4 is a fragmentary top plan view, with a portion broken away, of the insert and encapsulating foam, containing an inflation or deflation valve.

In the form of encapsulated insert disclosed in FIG. 4, a suitable check valve 30 is provided, which permits the inflating fluid to be forced into the chambers 15 of the insert by a suitable pump (not shown) or source of pressure. The check valve can be of the type similar to an ordinary automobile tire valve. Withdrawal of the pump results in automatic closing of the check valve and retention of the fluid under pressure in the insert chambers. In the event it is desired to deflate the insert, it is only necessary to depress the valve stem 31, allowing the fluid in the chambers to escape. With this valve arrangement, the pressure can be adjusted to be optimum for various different athletic activities or to suit the personal preference of the person wearing the shoes.

Figure 8:
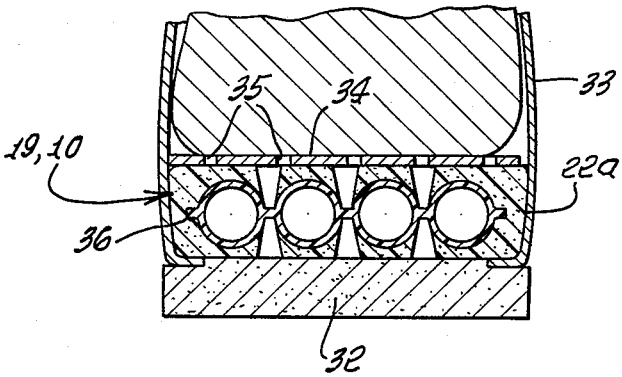
FIG. 8 is a cross-sectional view through the heel portion of the shoe of an encapsulated insert formed to function as an insole that can be slipped into an existing shoe.

As shown in FIG. 8, the encapsulated insert 19, 10 need merely be slipped into the upper portion of an existing shoe, resting upon an outsole 32 with the shoe upper 33 extending along the sides 22*a* of the encapsulated insole. If desired, a flexible moderator 34 having perforations 35 therein may bear against the upper surface of the encapsulating member 19, the foot bearing against the moderator. However, a moderator need not be used, since the encapsulated insert will function properly in its absence. In fact, the encapsulating material 19 functions as a moderator itself, bridging the spaces between the insert chambers and also encasing the perimeter portion 36 of the insert itself.

Figure 5:
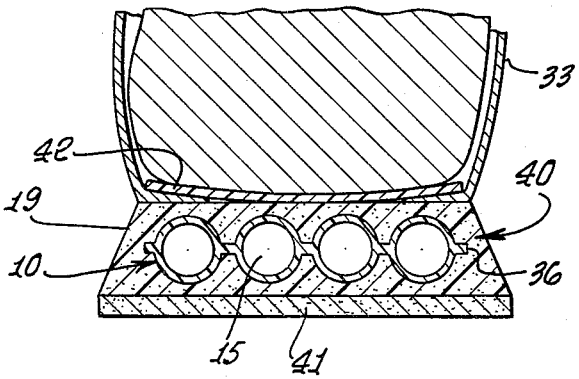
FIG. 5 is a cross-section through the heel portion of a shoe of an inflated insert encapsulated within a foam, the combination providing the midsole portion of the shoe.

As disclosed in FIG. 5, the insert 10 and the foam encapsulation member 19 surrounding it are used as the midsole 40 of a shoe, the upper 33 being cemented thereto. A tread or outsole 41 is suitably fixed to the bottom of the midsole, or, if desired, the outsole 41 may be omitted and the bottom of the midsole allowed to contact the supporting ground or other surface. A separate and removable conventional insole 42 may be placed in the shoe on top of the encapsulation member to function as a separate moderator element, although the insole 42 need not be used since the encapsulation member itself serves as a moderator, as noted above, filling in all the spaces around the inflated chambers 15 and also supporting the marginal portion 36 of the insert.

The encapsulation member 19 is deformable to transfer the load imposed upon it to the inflated insert 10, the chambers of which are also deformable. Thus, during walking, running or standing, the inflated insert and encapsulation member serve to absorb shock loads and to cushion the foot. To improve the effect of the insert and encapsulating member combination, the hardness of the foam material is matched with the pneumatic inflation pressure within the insert 10 so that the load-deflection characteristics of each complement one another in such a way that this combination provides the most ideal comfort and shock absorption for the foot and leg. When the inflation pressure is high, a stiffer foam encapsulating material is used. With lower pneumatic inflation pressures, a softer foam encapsulation material is used.

In the event that an air valve 30 is provided in the insert, its chambers can be inflated to the desired pressure by using air as the inflation medium in order to: achieve special dynamic responsive characteristics; tune the air spring to the size, stride and mass of the wearer's body; or achieve special levels of comfort. In the event that the pressure decreases below a desired value, additional air can be forced through the valve 30 into the insert chambers, or, conversely, if the pressure in the chambers is too high, some air can be allowed to bleed from the insert by depressing the valve stem 31 and effecting opening of the valve. It is, however, desirable to inflate the insert chambers with a large molecule gas, the material of the insert being such that the gas will not readily escape from the chambers 15. However, ambient air will diffuse through the insert into the chambers to add the partial pressure of the components of air to the inflation pressure of the large molecule gas within the insole.

The particular material from which the insert 10 may be made and the types of gases that may be used for inflating the chambers are set forth in application, Ser. No. 830,589. As set forth therein, the material of the insert can be selected from the following materials: polyurethane; polyester elastomer; fluoroelastomer; chlorinated polyethylene; polyvinyl chloride; chlorosulfonated polyethylene; polyethylene/ethylene vinyl acetate copolymer; neoprene; butadiene acrylonitrile rubber, butadiene styrene rubber; ethylene propylene polymer; natural rubber, high strength silicone rubber; low densite polyethylene; adduct rubber; sulfide rubber; methyl rubber; thermoplastic rubbers.

One of the above materials which has been found to be particularly useful in manufacturing the inflated insert is a polyurethane film.

Gases which have been found to be usable in pressure retention within the chambers are as follows: hexafluoroethane; sulfur hexafluoride; perfluoropropane; perfluorobutane; perfluoropentane; perfluorohexane; perfluoroheptane; octafluorocyclobutane; perfluorocyclobutane; hexafluoropropylene; tetrafluoromethane; monochloropentafluoroethane; 1, 2-dichlorotetrafluoroethane; 1, 1, 2-trichloro-1, 2, 2 trifluoroethane; chlorotrifluoroethylene; bromotrifluoromethane; and monochlorotrifluoromethane. These gases may be termed supergases.

The two most desirable gases for use in the insert are hexafluoroethane and sulfur hexafluoride.

Elastomeric foam materials from which the foam encapsulating member can be made include the following: polyether urethane; polyester urethane; ethylenevinylacetate/polyethylene copolymer; polyester elastomer (Hytrel); ethylenevinylacetate/polypropylene copolymer; polyethylene; polypropylene; neoprene; natural rubber; dacron/polyester; polyvinylchloride; thermoplastic rubbers; nitrile rubber; butyl rubber; sulfide rubber; polyvinyl acetate; methyl rubber; buna N.; buna S.; polystyrene; ethylene propylene; polybutadiene; polypropylene; silicone rubber.

The most satisfactory of the above-identified elastic foam materials are the polyurethanes, ethylenevinylacetate/polyethylene copolymer; ethylene vinylacetate/polypropylene copolymer, neoprene and polyester.

The foam encapsulating member 19 is permeable to air and essentially impermeable to the special gases, thus allowing the ambient air to pass therethrough and through the material 11, 12 of the insert 10 into the chambers 15 to enhance the fluid pressure therewithin, and preventing the fluid pressure from decreasing below a useful value, except after the passage of a substantial number of years. During use of the shoe when external loads are applied, some of the air will be lost through diffusion from the insole and through the encapsulating member. When the shoe is not in use (that is, when it is not under an external load), the device wll expand to its full, undistorted volume by virtue of the partial pressure to the special large molecule gas therein. The increase in volume will result in a reduction of the partial pressure of air in the device to a level below outside ambient pressure. Therefore, the mechanism of diffusion-pumping or reverse diffusion of air into the device will occur and continue until equilibrium is reached between the partial pressure of air within the device and the ambient air pressure outside. Thus, diffusion-pumping restores the internal air pressure back to its original pressure level.

Figure 10:
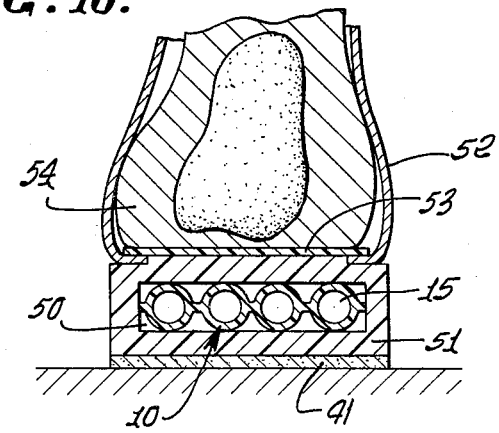
FIG. 10 is a cross-sectional view through the heel portion of a shoe, of an inflated insert located within a cavity in the midsole, disclosing a no-load condition.
Figure 11:
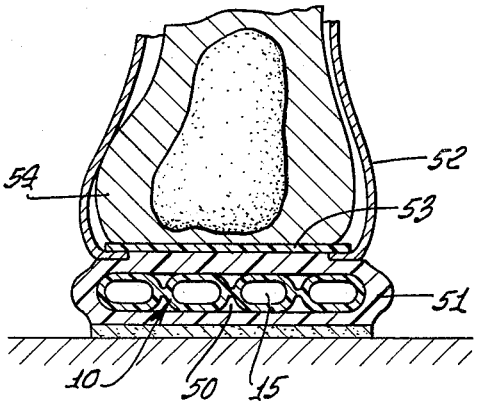
FIG. 11 is a view similar to FIG. 10, with the heel portion and insert under a loaded condition.

In the form of invention disclosed in FIGS. 10 and 11, an inflated insert 10 is placed within a preformed cavity 50 in an outsole 51 or elastic heel portion of a shoe, a counter 52 being suitably secured to the heel portion, with a conventional insole 53 resting upon the upper surface of the outer sole. As shown in FIG. 10, the heel 54 of the foot is disposed within the shoe counter, resting upon the insole 53, the mid-sole 51 and the inflated insole 10 therewithin being in a no-load condition. When the heel applies a load to the shoe, the mid-sole 51 will deflect at its mid-portion, the insert 10 being under compression and yieldable in proportion to the compression load applied by the heel (FIG. 11). When the load is released, the midsole 51 and the insert 10 will return to their original conditions as shown in FIG. 10.

The elastic heel portion 51 is also permeable, allowing the ambient air to pass therethrough into the cavity 50 and through the walls of the chambers 15 to their interiors, to add the partial pressure of the air components to the pressure of the gas initially inflating the insert. Also, the member 51 can be constructed to have ventilation holes leading to the cavity 51 which will allow air to be pumped in and out of the cavity as the midsole is alternately compressed and extended during walking or running.

With respect to all forms of the invention disclosed, the encapsulating member 19 or 51 functions as a moderator, bridging the gaps between the chambers 15 and other irregularities that might be present in the exterior of the inflated insert, providing a relatively smooth surface for appropriately supporting the foot.

In addition, the encapsulating member acts as a dashpot, slowing down the rate of energy rebound of the inflated insert 10, casuing the rate of rebound to be closer to the rate of movement, and more in harmony with, the dynamic characteristics of the foot-leg anatomical system. By incorporating the encapsulated insole 19, 10 in the shoe structure itself, the resulting weight of the shoe is reduced, which also reduces the energy expended by the person using the shoes during running or walking. Incorporation of the encapsulated insole into the structure of the shoe itself, as disclosed in FIG. 5, results in less relative movement between the foot and the adjacent inner surfaces of the shoe, minimizing, if not eliminating, the chafing of the foot and the production of blisters, calluses and discomfort. Additional heel counter stability can be achieved by making the encapsulating member 19, 51 of several different densities of elastomeric or foam material. For example, the side portions may be made of a less flexible material than the remainder of the encapsulating element.

The foam encapsulation technique can also be applied to the application where the inflated element is of the ped type. Peds are smaller versions of the inflated element 10 and are configured to be used primarily under those selected portions of the foot which experience the higher load condition during walking or running, i.e., the heel area and the ball-of-the-foot. When peds are foam encapsulated, they are properly placed within the foaming die and the foam fills the entire die cavity thereby securely integrating the peds into the assembly. The foam completely fills in the volume between and around the peds. Because each of the peds are separately inflated and sealed, they can be pressurized to different pressure levels, with the heel ped normally at a higher pressure than the ball ped.

I claim:

1. A structure to form part of a shoe, comprising a sealed sole member of elastomeric material providing a plurality of chambers, said chambers being inflatable with a gaseous medium under pressure to a desired initial value, and an elastomeric yieldable outer member encapsulating said sole member, said sole member having peaks and valleys in its upper and lower surfaces, the upper surface of said outer member being spaced above said peaks, said outer member extending downwardly from its upper surface to fill the space between said upper surface and said peaks and also to fill at least said valleys in said upper surface of said sole member, whereby the downward load of the wearer's foot is transmitted from said upper surface of said outer member through said outer member to the inflated chambers of said sole member.

2. A structure as defined in claim 1, said outer member being an elastomeric foam.

3. A structure to foam part of a shoe, comprising a sealed sole member of elastomeric material providing a plurality of chambers, said chambers being inflatable with a gaseous medium under pressure to a desired initial value, and a permeable elastomeric yieldable outer member encapsulating said sole member, said sole member being permeable, said gaseous medium under pressure in said chambers including a gas other than air, oxygen or nitrogen, said elastomeric material having characteristics of relatively low permeability with respect to said gas to resist diffusion of said gas therethrough from said chambers and of relatively high permeability with respect to the ambient air surrounding said sole member to permit diffusion of said ambient air through said elastomeric material into said chambers to provide a total pressure in each chamber which is the sum of the partial pressure of the gas in each chamber and the partial pressure of the air in each chamber, the diffusion rate of said gas in each chamber being substantially lower than the diffusion rate of nitrogen through said elastomeric material.

4. A structure as defined in claim 3, said outer member being a yieldable permeable foam through which said ambient air can pass for diffusion through said elastomeric material into said chambers.

5. A structure as defined in claim 1, said outer member filling said valleys in said upper and lower surfaces.

6. A structure as defined in claim 5, said outer member being a yieldable foam.

7. A structure as defined in claim 1, said plurality of chambers intercommunicating with one another.

8. A structure as defined in claim 3, wherein said gas is either hexafluoroethane; sulfur hexafluoride; perfluoropropane; perfluorobutane; perfluoropentane; perfluorohexane; perfluoroheptane; octafluorocyclobutane; perfluorocyclobutane; hexafluoropropylene; tetrafluoromethane; monochloropentafluoroethane; 1, 2-dichlorotetrafluoroethane; 1, 1, 2-trichloro-1, 2, 2 trifluoroethane; chlorotrifluorethylene; bromotrifluoromethane; or monochlorotrifluoromethane.

9. A structure as defined in claim 8, wherein said elastomeric material is either of: polyurethane; polyester elastomer; fluoroelastomer; chlorinated polyethylene; polyvinyl chloride; chlorosulfonated polyethylene; polyethylene/ethylene vinyl acetate copolymer; neoprene; butadiene acrylonitrile rubber; butadiene styrene rubber; ethylene propylene polymer; natural rubber; high strength silicone rubber; low density polyethylene; adduct rubber; sulfide rubber; methyl rubber or thermoplastic rubber.

10. A structure as defined in claim 8, said plurality of chambers intercommunicating with one another.

11. A structure as defined in claim 2, wherein said elastomeric foam either: polyether urethane; polyester urethane; ethylenevinylacetate/polyethylene copolymer; polyester elastomer (Hytrel); ethylenevinylacetate/polypropylene copolymer; polyethylene; polypropylene; neoprene; natural rubber; dacron/polyester; polyvinylchloride; theromplastic rubbers; nitrile rubber, butyl rubber; sulfide rubber; polyvinyl acetate; methyl rubber; buna N.; buna S.; polystyrene; ethylene propylene; polybutadiene; polypropylene; or silocone rubber.

12. A structure as defined in claim 8, said outer member being an elastomeric foam, wherein said elastomeric foam is either: polyether urethane; polyester urethane; ethylenevinylacetate/polyethylene copolymer; polyester elastomer (Hytrel); ethylenevinylacetate/polypropylene copolymer; polyethylene; polypropylene; neoprene; natural rubber, dacron/polyester; polyvinylchloride; theromplastic rubber; nitrile rubber; butyl rubber; sulfide rubber; polyvinyl acetate; methyl rubber; buna N.; buna S.; polystyrene; ethylene propylene; polybutadiene; polypropylene; or silicone rubber.

13. A structure as defined in claim 12, wherein said elastomeric material is either: polyurethane; polyester elastomer; fluoroelastomer; chlorinated polyethylene; polyvinyl chloride; chlorosulfonated polyethylene; polyethylene/ethylene vinyl acetate copolymer; neoprene; butadiene acrylonitrile rubber; butadiene styrene rubber; ethylene propylene polymer; natural rubber; high strength silicone rubber; low density polyethylene; adduct rubber; sulfide rubber; methyl rubber; or thermoplastic rubber.

14. A structure as defined in claim 1, said outer member comprising at least two parts separate from one another and movable toward each other to embrace said sole member, and means securing said parts in embracing relation to said sole member.

15. Footwear comprising a shoe upper, a sole below and secured to said upper, said sole including a sealed inner member of elastomeric material providing a plurality of chambers, said chambers being inflatable with a gaseous medium under pressure to a desired initial value, and said sole further including an elastomeric yieldable outer member encapsulating said inner member, said inner member having peaks and valleys in its upper and lower surfaces, the upper surface of said outer member being spaced above said peaks, said outer member extending downwardly from its upper surface to fill the space between said upper surface and said peaks and also to fill at least said valleys in said upper surface of said sole member, whereby the downward load of the wearer's foot is transmitted from said upper surface of said outer member through said outer member to the inflated chambers of said sole member.

16. Footwear as defined in claim 15, said outer member being an elastomeric foam.

17. Footwear as defined in claim 15, said inner member and outer member constituting a midsole, and an outsole secured to the underside of said outer member.

18. Footwear as defined in claim 17, said outer member being an elastomeric foam.

19. Footwear comprising a shoe upper, a sole below and secured to said upper, said sole including a sealed inner member of elastomeric material providing a plurality of chambers, said chambers being inflatable with a gaseous medium under pressure to a desired initial value, and said sole further including an elastomeric yieldable outer member encapsulating said inner member, said inner member and outer member constituting a midsole, an outsole secured to the inner side of said outer member, said outer member being a permeable elastomeric foam, said inner member being permeable, a gaseous medium under pressure in said chambers including a gas other than air, oxygen or nitrogen, said elastomeric material having characteristics of relatively low permeability with respect to said gas to resist diffusion of said gas therethrough from said chambers and of relatively high permeability with respect to the ambient air surrounding said sole member to permit diffusion of said ambient air through said elastomeric material into said chambers to provide a total pressure in each chamber which is the sum of the partial pressure of the gas in each chamber and the partial pressure of the air in each chamber, the diffusion rate of said gas in each chamber being substantially lower than the diffusion rate of nitrogen through said elastomeric material.

20. A structure as defined in claim 8, said chambers being initially inflated with a mixture of said gas and air.

21. A structure as defined in claim 7, a valve in said sole member through which said chambers are inflated and deflated.

22. A structure as defined in claim 21, wherein said valve is disposed in said member for location beneath the longitudinal arch of the foot.

23. A structure as defined in claim 1, wherein said sole member is inflated with air.

24. A structure as defined in claim 6, wherein said outer member has a plurality of recesses positioned at uninflated regions of said sole member.

25. A structure as defined in claim 1, said outer member being an impermeable foam.

* * * * *

US004219945B1

REEXAMINATION CERTIFICATE (2110th)

United States Patent [19]

Rudy

[11] B1 4,219,945

[45] Certificate Issued Oct. 19, 1993

[54] FOOTWEAR

[75] Inventor: Marion F. Rudy, Northridge, Calif.

[73] Assignee: Robert C. Bogert, Woodland Hills, Calif.

Reexamination Request:
No. 90/002,627, Jan. 29, 1992

Reexamination Certificate for:

| | |
|---|---|
| Patent No.: | **4,219,945** |
| Issued: | **Sep. 2, 1980** |
| Appl. No.: | **918,790** |
| Filed: | **Jun. 26, 1978** |

Related U.S. Application Data

[63] Continuation-in-part of Ser. No. 830,589, Sep. 6, 1977, Pat. No. 4,183,156.

[51] Int. Cl.[5] ..... A43B 13/20
[52] U.S. Cl. ..... 36/29; 36/44
[58] Field of Search ..... 36/29, 44

[56] References Cited

U.S. PATENT DOCUMENTS

| | | | |
|---|---|---|---|
| 1,145,534 | 7/1915 | Wetmore . | |
| 1,193,608 | 8/1916 | Poulson . | |
| 1,241,832 | 10/1917 | Druckenmiller . | |
| 1,304,915 | 5/1919 | Spinney | 36/29 |
| 1,498,838 | 7/1924 | Harrison, Jr. . | |
| 1,514,468 | 11/1924 | Schopf . | |
| 2,074,286 | 12/1934 | Sullivan . | |
| 2,080,499 | 5/1937 | Nathansohn . | |
| 2,100,492 | 11/1937 | Sindler | 36/29 |
| 2,177,116 | 10/1939 | Persichino . | |
| 2,762,134 | 9/1956 | Town . | |
| 3,005,272 | 10/1961 | Shelare et al. | 36/59 R |
| 3,225,463 | 12/1965 | Burnham . | |
| 3,375,211 | 3/1968 | Parrish . | |
| 3,375,212 | 3/1968 | Bonner, Jr. . | |
| 3,491,173 | 1/1970 | Kobsa . | |
| 3,724,105 | 4/1973 | Weight | 36/44 |
| 3,889,807 | 6/1975 | Feinberg et al. . | |
| 3,922,801 | 12/1975 | Zente . | |
| 4,012,867 | 3/1977 | Lainchbury et al. . | |
| 4,098,504 | 7/1978 | Koziol et al. . | |
| 4,100,686 | 7/1978 | Sgarlato et al. . | |
| 4,124,117 | 11/1978 | Rudy . | |
| 4,161,247 | 7/1979 | Feinberg et al. . | |

FOREIGN PATENT DOCUMENTS

| | | |
|---|---|---|
| 1195473 | 10/1962 | Fed. Rep. of Germany . |
| 1939460 | 2/1971 | Fed. Rep. of Germany . |
| 2214492 | 8/1974 | France . |
| 1145932 | 3/1969 | United Kingdom . |

*Primary Examiner*—Paul T. Sewell

[57] ABSTRACT

A shoe embodying a multiple chambered pneumatically inflated insert encapsulated in a yieldable foam which acts as a bridging moderator filling in irregularities of the insert and providing a substantially smooth and contoured surface for supporting the foot in a comfortable manner. The encapsulated insert can be used as an inner sole slipped into an existing shoe, or it can be used as an integral, composite midsole or outsole portion of a shoe.

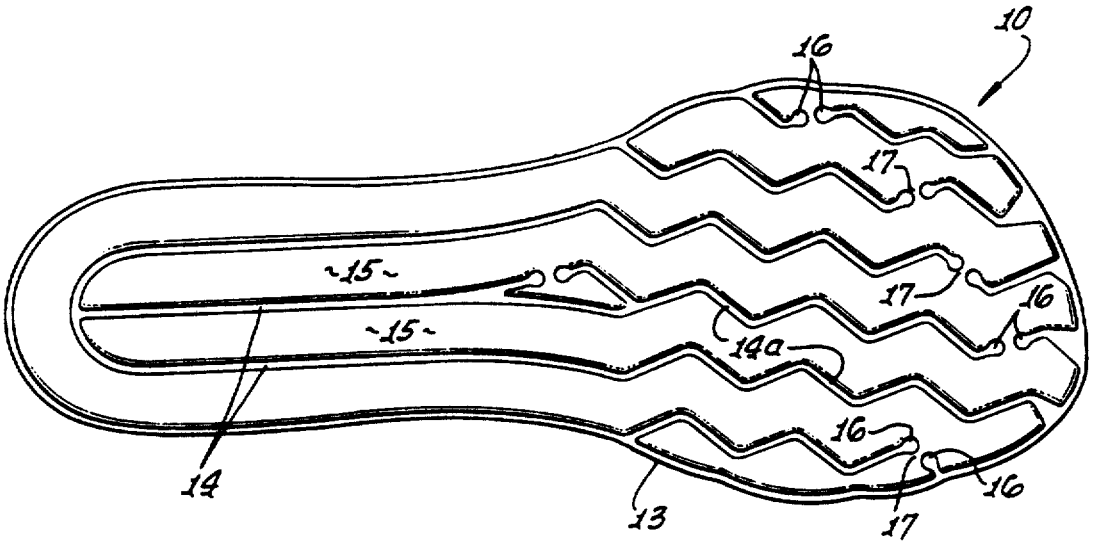

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 3, 4, 8, 9, 10, 12, 13, 19 and 20 is confirmed.

Claim 7 is cancelled.

Claims 1, 14, 15, 21, 24 and 25 are determined to be patentable as amended.

Claims 2, 5, 6, 11, 16, 17, 18, 22 and 23, dependent on an amended claim, are determined to be patentable.

1. A structure to form part of a shoe, comprising a sealed sole member of elastomeric material providing a plurality of chambers, said chambers being inflatable with a gaseous medium under pressure to a desired initial value *and in fluid communication with one another*, and an elastomeric yieldable outer member encapsulating said sole member, said sole member *extending generally along a plane and* having peaks and valleys in its upper and lower surfaces, *said valleys including an uninflated region formed of said elastomeric material between chambers substantially parallel to said plane in which said sole member generally extends*, the upper surface of said outer member being spaced above said peaks, said outer member extending downwardly from its upper surface to fill the space between said upper surface and said peaks and also to fill at least said valleys in said upper surface of said sole member, whereby the downward load of the wearer's foot is transmitted from said upper surface of said outer member through said outer member to the inflated chambers of said sole member.

14. A structure as defined in claim 1, said outer member comprising at least two parts separate from one another and movable toward each other to embrace said sole member, and means securing said parts in embracing relation to said sole member.

15. Footwear comprising a shoe upper, a sole below and secured to said upper, said sole including a sealed inner member of elastomeric material providing a plurality of chambers, said chambers being inflatable with a gaseous medium under pressure to a desired initial value *and in fluid communication with one another*, and said sole further including an elastomeric yieldable outer member encapsulating said inner member, said inner member *extending generally along a plane and* having peaks and valleys in its upper and lower surfaces, *said valleys including an uninflated region formed of said elastomeric material between chambers substantially parallel to said plane in which said sole member generally extends*, the upper surface of said outer member being spaced above said peaks, said outer member extending downwardly from its upper surface to fill the space between said upper surface and said peaks and also to fill at least said valleys in said upper surface of said [sole] *inner* member, whereby the downward load of the wearer's foot is transmitted from said upper surface of said outer member through said outer member to the inflated chambers of said [sole] *inner* member.

21. A structure as defined in claim [7] *1*, a valve in said sole member through which said chambers are inflated and deflated.

24. A structure as defined in claim 6, wherein said outer member has a plurality of recesses positioned at *said* uninflated regions of said sole member.

25. A structure as defined in claim [1] *3*, said outer member being [an impermeable foam] *a foam impermeable to said gas other than air, oxygen or nitrogen.*

* * * * *